United States Patent [19]

Hornak et al.

[11] 4,196,020

[45] Apr. 1, 1980

[54] REMOVABLE WASH SPRAY APPARATUS FOR GAS TURBINE ENGINE

[75] Inventors: Steven S. Hornak, Monroe; Robert S. Lowdermilk, Shelton; Robert A. Miller, Bridgeport, all of Conn.

[73] Assignee: Avco Corporation, Stratford, Conn.

[21] Appl. No.: 960,909

[22] Filed: Nov. 15, 1978

[51] Int. Cl.[2] ..... B08B 3/02; B08B 9/00

[52] U.S. Cl. ..... 134/167 R; 134/169 A; 134/199; 60/39.33

[58] Field of Search ..... 60/39.33; 134/166 R, 134/166 C, 167 R, 167 C, 168 R, 168 C, 169 A, 169 R, 169 C, 172, 198–199

[56] References Cited

U.S. PATENT DOCUMENTS

| | | | |
|---|---|---|---|
| 1,829,831 | 11/1931 | Hiskey | 134/199 UX |
| 2,147,247 | 2/1939 | Doty et al. | 134/167 R X |
| 2,727,734 | 12/1955 | Vincent | 134/198 X |
| 3,630,777 | 12/1971 | Ishizawa et al. | 134/169 R X |
| 4,059,123 | 11/1977 | Bartos et al. | 134/169 A X |

*Primary Examiner*—Robert L. Bleutge
*Attorney, Agent, or Firm*—Ralph D. Gelling

[57] ABSTRACT

An engine wash spray apparatus is releasably connected to the leading edge of a gas turbine engine for dispersing a cleaning, rinsing, or preservative fluid to the air intake area of the engine and on into the engine's internal air flow path. The apparatus includes a manifold having a plurality of nozzles of specific configuration and specific spaced relationship to achieve a uniform spray pattern, with each nozzle issuing an elongated spray, the longitudinal axis of which is generally perpendicular to a radius of the engine inlet, and with the nozzles being arranged within the engine inlet to achieve the overlapping wash spray. The cleaning fluid is dispersed within the air flow path of the engine while the engine is cranked, whereby the fluid is carried through the entire engine flow path for cleaning of the engine components.

4 Claims, 3 Drawing Figures

REMOVABLE WASH SPRAY APPARATUS FOR GAS TURBINE ENGINE

The subject invention relates to a new and improved wash spray apparatus to be releasably connected to a gas turbine engine for maintenance of the engine and more particularly, for spraying into an engine, while the engine is being cranked, a cleaning, rinsing or preservative fluid in a desired spray pattern for impingement on the various components of the engine as the fluid is drawn through the gas turbine engine.

As is readily apparent in the operation of a gas turbine engine associated with an aircraft or helicopter, salt and dust substances tend to adhere to the various internal components of the gas turbine engine, including the blades, the cowling, and the like. Unless such salt and dust is removed from the internal components of the gas turbine engine at periodic intervals, the buildup of the dust or salt on the components could cause a loss in efficiency of the engine. Generally, to operate engines efficiently, the internal portions of the engine should be cleaned daily in salt laden atmosphere or as often as other atmospheric conditions may require.

Heretofore, it has been known to attempt to clean a gas turbine engine by simply spraying a water spray from a conventional garden hose into the inlet of the engine, while the engine is cranked. Of course, the problem associated with the spray from a simple garden hose is that it can be relatively concentrated and bulky, and could cause localized stress on a portion of a component within the engine, possibly leading to subsequent failure of the engine component, such as a blade.

It has also been known, as exemplified by U.S. Pat. No. 4,059,123 which issued on Nov. 22, 1977 to Boddis et al and is entitled "Cleaning and Preserving Preservation Unit for Turbine Engine", which patent is assigned to the assignee of the subject application, to provide a mobile cart-mounted unit including a relatively simple spray ring assembly to be releasably connected to the intake of a gas turbine engine. The spray ring assembly basically comprises a tubular section including a plurality of annular holes therein, which provide generally conical sprays of the preservative or cleaning fluid. Although the spray pattern from the spray ring assembly is more uniform as compared to the spray from a garden hose, the conical distribution of the individual spray results in limited overlapping of adjacent sprays, whereby the components of the engine located adjacent the intake, and in particular, the struts, or portions thereof, which extend between the central hub and the outer cowling, may not be fully washed by the spray, thereby resulting in incomplete washing of the engine components.

It has been known to provide a manifold spray assembly about an engine housing, and more particularly externally thereof, with a series of spray nozzles, also of conical spray dispersion pattern, with the axes of the sprays extending radially relative to the engine intake. In such assembly the sprays are directed generally perpendicular to the air flow path through the engine. Hence, the spray pattern of the radially directed sprays may not be effective to insure that the components of the engine adjacent the intake are fully immersed in the spray.

Accordingly, it is an object of the subject invention to overcome the shortcomings of the prior art apparatus for cleaning and preserving a gas turbine engine, and more particularly to provide an engine wash spray apparatus comprising a manifold assembly which is releasably connected to the leading edge of the engine and includes an array of spray nozzles. The spray nozzles are located at specific locations within the engine relative to the radially extending struts, and each nozzle has an elongated spray pattern, the longitudinal axis of which is generally perpendicular to a radius of the engine inlet. By this arrangement, the sprays emanating from the nozzles within the inlet achieve the desired overlapping wash spray, and are effective to completely wash the entire length of the adjacent strut structures disposed in the engine inlet.

Further objects and advantages of the invention will become apparent from a reading of the following detailed description taken in conjunction with the drawings in which.

Figure 1:
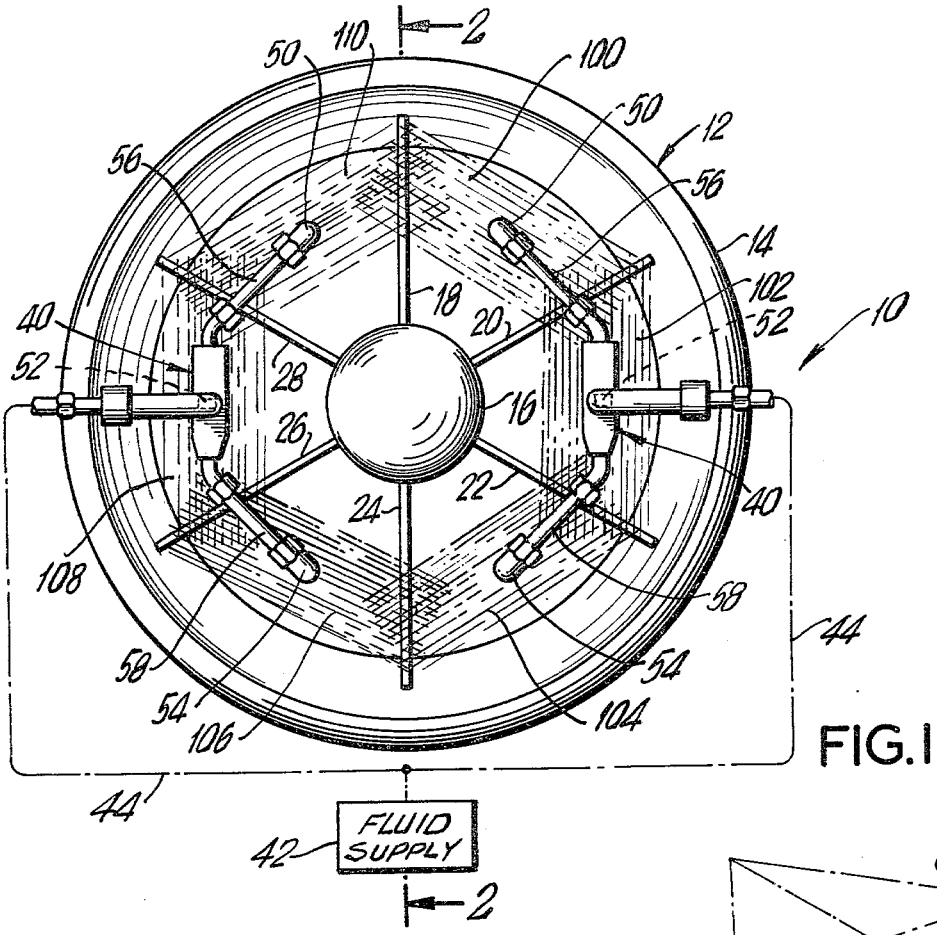
FIG. 1 is a front elevational view, in part schematic, of the inlet of a gas turbine engine to which is releasably connected an engine wash spray apparatus according to the subject invention.
Figure 2:
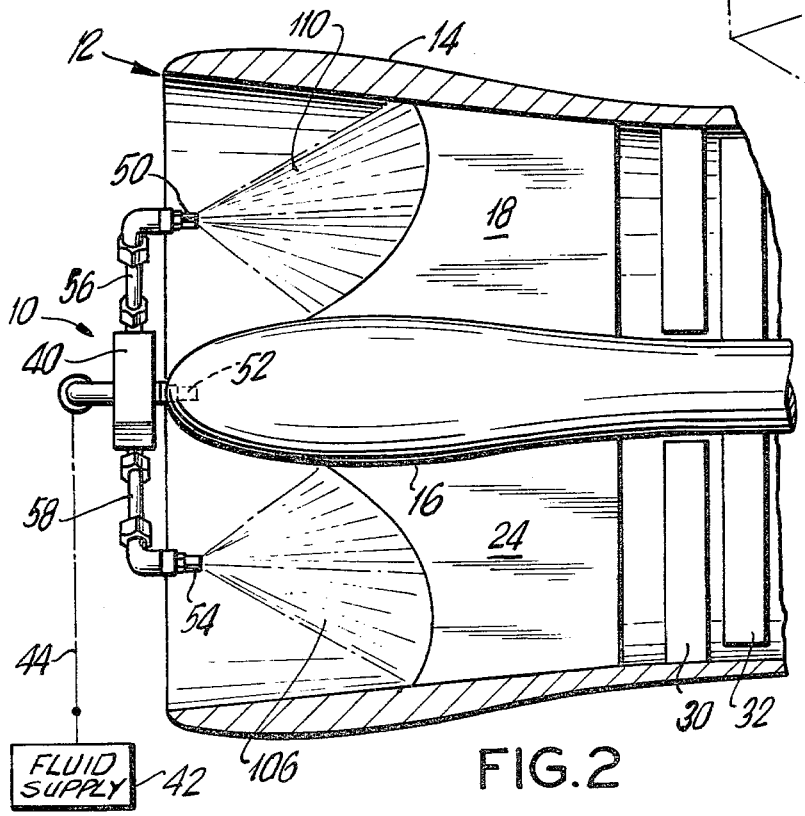
FIG. 2 is a cross-sectional view taken along line 2—2 in FIG. 1.

Referring to FIGS. 1 and 2, the wash spray apparatus of the subject invention is generally designated by the numeral 10 and is adapted to be releasably connected by suitable quick connect/disconnect means (not shown) to the air inlet 12 of a gas turbine engine. The air inlet is defined by the outer housing or cowling 14 which is generally annular and is spaced from the center body or central hub 16 within the air inlet by a plurality of radially extending struts 18–28. As shown in FIG. 2, each strut extends along the longitudinal axis of the engine 12 and includes a curved leading edge portion, as well as a generally straight rear edge. Disposed downstream of the struts 18–26 are the blades 30, 32 of the engine compressor.

Figure 3:
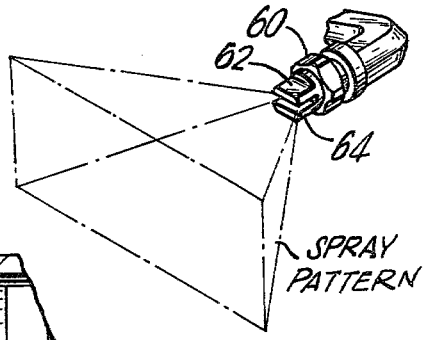
FIG. 3 is a perspective view of the tip of a spray nozzle of the subject apparatus, and also including a schematic representation of the spray emanating from the nozzle tip.

The wash spray apparatus 10 of the subject invention is designed to provide a controlled spray of cleaning fluid in order to remove dust and salt buildup on the internal walls of the outer housing 14, the struts 18–28, the central hub 16, as well as the blades of the compressor after which the fluid is drawn through the reamining portions of the engine. At such time, the gas turbine engine is cranked for creating an air flow path to aid in removing dust or salt deposits on the components within the gas turbine engine. In order to insure that all of the portions of the engine are thoroughly cleaned, especially in the leading edge portion of the engine where salt and dust deposits are built up to a greater extent, it is important that the wash spray be uniformly distributed in order to impinge on substantially all of the surfaces of the components within the air intake of the engine. To this end, the wash spray apparatus includes a manifold assembly including two manifolds 40, 40 which are releasable connected by suitable quick connect/disconnect means to the leading edge of the engine inlet, and are in communication with a source of fluid supply 42 by tubing 44. Each manifold 40 includes three spray nozzles 50, 52 and 54 connected by suitable tubing 56 and 58. In the gas turbine engine as illustrated in FIGS. 1 and 2, the configuration of each manifold is such that each spray nozzle is disposed between two adjacent struts 18–26, and located approximately onehalf of the radial distance between the central hub 16 and outer housing 14. As shown in FIG. 3, each nozzle terminates in a tip 60 having two parallel, flat projections 62 and 64 which control the spray pattern of the fluid discharged from the nozzle. The spray pattern from the nozzle tip 60 is generally pyramidal, having a generally rectangular base, as shown in dotted lines in FIG. 3. As mounted in the engine intake (see FIGS. 1 and 2) the spray patterns are generally elongated, pyramidal shape, with the elongated axis of the base of each pyramidal flow being perpendicular to a radius extending between the central hub 16 and the outer housing 14. In addition, as shown in FIG. 1, adjacent nozzles of each manifold 40 are located such that their pyramidal-shaped spray patterns overlap the strut intermediate such nozzles, thereby insuring complete 360° coverage of the fluid spray into the engine intake. In addition, as shown in FIG. 2, the pyramidal-shaped spray pattern emanating from each nozzle is at a sufficient angle, on the order of 95°, so as to substantially impinge on the entire curved leading edges of the adjacent struts. The spray emanating from each nozzle is a fine atomized spray which is under pressure, usually on the order of 80 pounds per square inch. However, since the spray is atomized, it will not cause structural damage to the components within the engine intake. In addition to the direct impingement of the sprays on the engine components, by virtue of the relationship of the nozzles 50, 52 and 54 to the struts, as the spray patterns bounce off the sides and leading edges of the adjacent struts, the atomized fluid is deflected so as to insure that the complete air flow path through the engine is subjected to the spray.

In a typical use of the subject wash spray apparatus, the manifolds 40, 40 are releasably connected to the leading edge of the engine housing 14, with the spray nozzles 50, 52 and 54 being disposed intermediate the struts 20–28 at substantially 60° intervals. Utilizing a mobile cart-mounted unit as described in U.S. Pat. No. 4,059,123, electricity is supplied by the cart to the various portions of the engine in order to crank the gas turbine engine, and a pressurized fluid cleaning agent is provided from fluid supply 42 via tubing 44 to the manifolds 40, 40 and then through the spray nozzles 50, 52, and 54. The overlapping spray patterns from the nozzles are designated by numerals 100–110 is FIGS. 1 and 2, with the leading edge of each strut 18–26 being subjected to the high pressure spray on opposite sides thereof, and with the spray which bounces off the struts then being directed to other components within the engine intake. Following application of the cleansing agent, a water rinse would usually be provided through the manifolds 40 to the nozzles, and then a fluid preservative may be applied to the engine intake. After the application of the preservative, the manifolds 40, 40 are disconnected from the engine intake.

Accordingly, there is provided a new and improved wash spray system having a "put-on/take-off" manifold capable of dispensing a cleaning, rinsing, or preservative fluid to the air intake area of a jet turbine engine, and then on into the engine internal air flow path, while the engine is being cranked. The exact structure used to clamp the manifold assembly in place will vary from engine to engine since it depends on the configuration of the engine housing. Each nozzle of the manifold assembly is specifically located relative to the engine intake struts, and also relative to one another such that the spray patterns of adjacent nozzles overlap, and are specifically designed to insure the complete washing of the struts, as well as the other portions of the engine intake. Each nozzle tip includes a specific configuration having two parallel flat projections which insure a generally pyramidal spray pattern, of elongated rectangular base. The spray patterns from the subject apparatus coact with the internal components of the air intake, and in particular, with the struts, to insure a uniform dispersion of fluid within the entire intake of the engine. The pressurized flow from the nozzles insures that dust and salt are removed from the critical engine components, such as the blade tips and the inside walls of the outer housing, as well as along the length of the center hub and the struts.

Although a preferred embodiment of the invention has been illustrated and described, it should be understood that many additions, alterations, and variations may be made without departing from the scope and spirit of the invention as defined by the following appended claims.

What is claimed is:

1. A wash spray apparatus for use with a gas turbine engine including an intake portion defined by an outer cowling, a central hub, and a plurality of spaced, radially extending struts interconnecting said hub and cowling, said wash spray apparatus comprising:

a manifold assembly releasably secured to the cowling and including an array of spray nozzles disposed within said inlet, each nozzle being positioned upstream of said struts and disposed intermediate two adjacent struts, the spray flow path of each nozzle being generally aligned with the longitudinal axis of the engine, and with the tip of each nozzle including two parallel, flat projections such that the spray pattern of said nozzle is generally pyramidal including a generally elongated rectangular base, the longitudinal axis of which is generally perpendicular to the radial axis of the engine inlet, whereby the sprays from said nozzles provide an overlapping wash spray substantially along the entire length of the adjacent struts and the inside surface of the cowling.

2. Engine wash spray apparatus as in claim 1 wherein the angle of spray of each nozzle in the direction extending along the longitudinal axis of the engine is approximately 95°.

3. Engine wash spray apparatus as in claim 1 wherein the manifold assembly includes six spray nozzles disposed at 60° intervals.

4. Engine wash spray apparatus as in claim 1 wherein said manifold assembly comprises two manifolds interconnected to a common supply of wash solution.

* * * * *